US009528755B2

(12) United States Patent
Becke et al.

(10) Patent No.: US 9,528,755 B2
(45) Date of Patent: Dec. 27, 2016

(54) REFRIGERATION DEVICE WITH INTENSIVE REFRIGERATION FUNCTION

(75) Inventors: Christoph Becke, Grosskarolinenfeld (DE); Max Eicher, München (DE); Swetlana Gorodezki, München (DE); Maike Kirschbaum, München (DE); Ralph Staud, München (DE); Thomas Tischer, Haar (DE)

(73) Assignee: BSH Hausgeräte GmbH, Munich (DE)

( * ) Notice: Subject to any disclaimer, the term of this patent is extended or adjusted under 35 U.S.C. 154(b) by 539 days.

(21) Appl. No.: 14/241,660

(22) PCT Filed: Aug. 30, 2012

(86) PCT No.: PCT/EP2012/066884

§ 371 (c)(1),
(2), (4) Date: Feb. 27, 2014

(87) PCT Pub. No.: WO2013/030292

PCT Pub. Date: Mar. 7, 2013

(65) Prior Publication Data

US 2014/0190193 A1 Jul. 10, 2014

(30) Foreign Application Priority Data

Sep. 1, 2011 (DE) ..... 10 2011 081 952

(51) Int. Cl.
*G05D 23/32* (2006.01)
*F25D 29/00* (2006.01)

(52) U.S. Cl.
CPC ..... *F25D 29/00* (2013.01); *F25D 2400/28* (2013.01); *F25D 2400/30* (2013.01);
(Continued)

(58) Field of Classification Search
CPC .. F25D 29/00; F25D 2400/28; F25D 2400/30; F25D 2600/02; F25D 2600/04
See application file for complete search history.

(56) References Cited

U.S. PATENT DOCUMENTS 4,332,142 A * 6/1982 Prada ..... F25D 21/04 62/152
4,967,568 A * 11/1990 Harnden, Jr. ..... F25D 17/065 62/155

(Continued)

FOREIGN PATENT DOCUMENTS

DE 197 50 053 5/1999
EP 2 224 195 9/2010

OTHER PUBLICATIONS

International Search Report issued for PCT/EP2012/066884, mailed Mar. 26, 2013.

(Continued)

*Primary Examiner* — Ljiljana Ciric
(74) *Attorney, Agent, or Firm* — Nixon & Vanderhye P.C.

(57) ABSTRACT

A refrigeration device has at least one storage chamber, a cold generator which refrigerates the storage chamber, and a regulating unit which regulates the performance of the cold generator and can be switched between an operating state of low average performance in which the performance of the cold generator is regulated in order to maintain the temperature of the storage chamber within a desired range, and an operating state of high average performance of the cold generator in which the temperature of the storage chamber falls below the desired range. A timer is designed to switch the refrigeration device periodically into the operating state of high average performance at times that can be set by the user.

5 Claims, 3 Drawing Sheets

(52) U.S. Cl.
CPC .... *F25D 2400/361* (2013.01); *F25D 2600/02* (2013.01); *F25D 2600/04* (2013.01)

(56) References Cited

U.S. PATENT DOCUMENTS 5,787,718 A 8/1998 Jeong
6,148,625 A * 11/2000 Camp ..... G07F 9/105 62/155
6,158,227 A * 12/2000 Seeley ..... G01K 1/14 340/585
6,223,817 B1 * 5/2001 Oden ..... F25D 29/00 165/232
6,244,061 B1 * 6/2001 Takagi ..... F25B 49/025 62/228.4
6,389,822 B1 * 5/2002 Schanin ..... F25D 29/00 221/150 R
6,397,607 B1 * 6/2002 Camp ..... G07F 9/105 62/155
6,427,772 B1 * 8/2002 Oden ..... F25D 21/006 165/11.1
2002/0011072 A1 * 1/2002 Hiraoka ..... F25D 11/02 62/126
2003/0056526 A1 * 3/2003 Holmes ..... F25D 29/00 62/156
2004/0050079 A1 * 3/2004 Holmes ..... F25D 11/02 62/187
2004/0093125 A1 * 5/2004 Schanin ..... F25D 29/00 700/296
2004/0112070 A1 * 6/2004 Schanin ..... F25D 29/00 62/132
2004/0117330 A1 * 6/2004 Ehlers ..... F24F 11/0012 705/412
2004/0244389 A1 * 12/2004 Denvir ..... F25D 21/002 62/156
2005/0156870 A1 * 7/2005 Flinner ..... F25D 29/00 345/107
2005/0178135 A1 * 8/2005 Schanin ..... F25D 29/00 62/228.1
2006/0111815 A1 * 5/2006 Schanin ..... G07C 3/08 700/276
2006/0196199 A1 * 9/2006 Hunt ..... F25D 29/00 62/132
2006/0260333 A1 * 11/2006 Wetekamp ..... F25D 11/02 62/135
2006/0260335 A1 * 11/2006 Montuoro ..... F25B 49/02 62/236
2006/0266059 A1 * 11/2006 Wetekamp ..... F25C 5/005 62/187
2007/0005195 A1 * 1/2007 Pasquale ..... H02J 15/00 700/295
2007/0043478 A1 * 2/2007 Ehlers ..... F24F 11/0012 700/276
2007/0125104 A1 * 6/2007 Ehlers ..... F25D 27/005 62/157
2008/0195944 A1 * 8/2008 Lee ..... F25D 29/00 715/706
2010/0206540 A1 8/2010 Sonoda et al.
2011/0088415 A1 * 4/2011 Lacey ..... F25B 47/02 62/80
2011/0095017 A1 * 4/2011 Steurer ..... H02J 3/14 219/493
2011/0098869 A1 * 4/2011 Seo ..... G01D 4/004 700/296
2011/0175742 A1 * 7/2011 Shin ..... F25D 17/065 340/635
2011/0296852 A1 * 12/2011 Wyn-Davies ..... F25D 29/00 62/56
2012/0029719 A1 * 2/2012 Besore ..... G05D 23/1904 700/296
2012/0047921 A1 * 3/2012 Besore ..... F25D 21/06 62/80
2012/0130559 A1 * 5/2012 Besore ..... G05D 23/1923 700/300
2013/0268134 A1 * 10/2013 Tuller ..... A47L 15/0047 700/291
2014/0319993 A1 * 10/2014 Kimura ..... F25D 11/00 312/405
2015/0000316 A1 * 1/2015 Sato ..... F25D 23/00 62/127
2015/0007590 A1 * 1/2015 Yashar ..... F25C 1/00 62/71
2015/0121925 A1 * 5/2015 Park ..... F25B 49/022 62/151
2015/0276277 A1 * 10/2015 Keleshian ..... F25B 5/04 62/236

OTHER PUBLICATIONS

Foreign-language Written Opinion of the International Searching Authority PCT/EP2012/066884, mailed Mar. 26, 2013.

* cited by examiner

REFRIGERATION DEVICE WITH INTENSIVE REFRIGERATION FUNCTION

This application is the U.S. national phase of International Application No. PCT/EP2012/066884, filed 30 Aug. 2012, which designated the U.S. and claims priority to DE Application No. 10 2011 081 952.5, filed 1 Sep. 2011, the entire contents of each of which are hereby incorporated by reference.

The present invention relates to a refrigeration device, in particular a domestic refrigeration device, with intensive refrigeration function.

Conventional domestic refrigeration devices such as for instance refrigerators or freezers in most instances have a cold generator, which is switched on and off with the aid of measured values of a temperature sensor arranged on a storage chamber of the device, in order to keep the temperature of the storage chamber within a target range. Furthermore, many such refrigeration devices have an intensive refrigeration mode, in which the cold generator operates continuously, even if this results in the temperature of the storage chamber dropping below the target range. The use of the intensive refrigeration mode is recommended, in order to rapidly chill quantities of newly stored, warm refrigerated products, for instance several days worth of provisions, to within the target range.

Many users only activate the intensive refrigeration mode when they are about to store their purchases in the refrigeration device. Such a procedure is not very efficient. With the majority of conventional cold generators, the power cannot be switched between various, non-vanishing stages, but only the average power throughout the duration of the switch-on and off phases of the cold generator can be regulated. If a user loads a large quantity of warm refrigerated product into such a refrigeration device and switches on the intensive refrigeration mode, then the cold generator starts and operates continuously for a few hours, without switching off if the lower limit of the target range is not reached. If the user fails to activate the intensive refrigeration mode when loading the refrigerated product, a few minutes can then elapse until the temperature of the storage chamber reaches the upper limit of the target range and the cold generator is switched on. However, when it is switched on, it operates with the same power as in the intensive refrigeration mode until the lower limit of the target range is reached. A heating-up of refrigerated product already located previously in the storage chamber due to the newly loaded products cannot be prevented in each case. I.e. if the intensive refrigeration mode is only switched on during the loading process, its efficiency is minimal. In order to use the intensive refrigeration mode efficiently, it is necessary to activate the same before the warm refrigerated product is loaded. The storage chamber can then be cooled down at the point in time at which the warm refrigerated product is loaded, namely to below the target range, the warm refrigerated product cools down more quickly in the cold environment and even if refrigerated product which is already disposed in the storage chamber heats up as a result, it does not reach such a high temperature as in the case whereby the intensive refrigeration mode is only switched on during loading.

In order to effectively use the intensive refrigeration mode in the case of a conventional refrigeration device, a user must therefore activate the same when he leaves the house to go shopping, and return with purchases as soon as the storage chamber is cooled down to significantly below the target range. Such a requirement is clearly unrealistic.

The object of the present invention is therefore to create a refrigeration device, in which efficient use of the intensive refrigeration mode is facilitated.

The object is achieved by, in the case of a refrigeration device, in particular a domestic refrigeration device, having a storage chamber, a cold generator cooling the storage chamber and a regulation unit regulating the power of the cold generator, which can be switched between an operating state of low average power, in which the power of the cold generator is regulated in order to maintain the temperature of the storage chamber within a target range, and an operating state of high average power of the cold generator in which the temperature of the storage chamber falls to below the desired range, a timer being provided, which is configured to switch the refrigeration device periodically into the operating state of high average power at times that can be set by the user. A user who goes shopping at regularly recurring times, for instance on the way home from work, and as a result arrives home at, to some degree, reproducible times with his shopping, can program the inventive refrigeration device such that prior to his arrival, this promptly switches over into the operating state of high average power so that the storage chamber is effectively pre-cooled upon his arrival.

Since the times at which the majority of users go shopping recur on a weekly basis, the switchover times of the refrigeration device which can be defined by the user are also to be periodic in terms of weekly cycle.

In order to define the switchover times, a starting time of the operating state of high average power can be entered on a user interface of the refrigeration device. The user himself is then obliged to select this start time in good time before his expected arrival.

Another, more user-friendly possibility is to provide the user with the option of entering a time at the user interface, which is later than the start time of the operating state of high average power, in particular the time of his predicted arrival. In this case, the regulating unit is responsible for switching into the operating state of high average power in good time prior to the point in time determined by the user, so that the storage chamber is adequately pre-cooled at the defined point in time and is preferably at a temperature below the target range.

If no warm refrigerated product is loaded, while the operating state of high average power continues, then the cold generator can subsequently remain switched off for a while before the temperature of the storage chamber reaches the upper edge of the target range again. A user can make use of this by defining a time for the operation with high average power, which lies ahead of a time span in which he is likely to be in the direct vicinity of the refrigeration device, and would prefer not to be disturbed by operating noise of the cold generator.

The time during which a disturbance by operating noises of the cold generator can be prevented can even be extended further if, subsequent to the operating state of high average power, the cold generator remains switched off until the temperature of the storage chamber has risen to above the target range. Since such a significant rise in temperature is however not generally desirable, it should expediently be adjustable at the user interface as to whether the operating state of low average power is to follow the operating state of high average power immediately, or whether the cold generator is to remain switched off, until the temperature has risen to above the target range.

Further features and advantages of the invention result from the subsequent description of exemplary embodiments with respect to the appended figures.

Features of the exemplary embodiments which are not mentioned in the claims also emerge from this description and the figures. Such features can also appear in combinations other than those disclosed here specifically. The fact that several such features are mentioned in the same paragraph or in another type of context with one another therefore does not justify the conclusion that they can only occur in the specifically disclosed combination. Instead, it is basically assumed that individual features can be omitted or modified, provided these do not compromise the functionality of the invention, in which:

Figure 1:
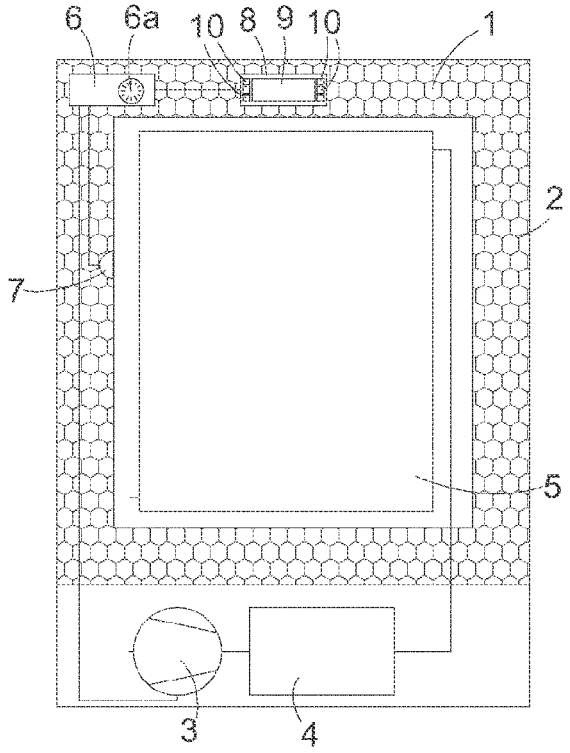
FIG. 1 shows a block diagram of the refrigeration device, to which the present invention can be applied.

FIG. 1 shows a schematic representation of a refrigeration device, in particular a domestic refrigerator or freezer, to which the present invention can be applied. The refrigeration device includes one or also a number of storage chambers 2 for refrigerated products surrounded by a heat-insulating housing 1 and a cold generator for cooling each storage chamber 2, which comprises, in a manner known per se, a compressor 3 for coolant, a condenser 4, in which coolant sealed adiabatically by the compressor 3 outputs heat to the environment, and condenses in this way, and an evaporator 5, in which the condensed coolant relaxes under the intake of heat and the coolant vapor developing in the process is drawn in again by the compressor 3. The evaporator 5 is shown here, for the sake of simplicity, as a rear wall evaporator, it nevertheless goes without saying that the invention can also be applied to any evaporator types, in particular also to NoFrost evaporators.

The compressor 3 can be any type which is known per se. It is most commonly a piston compressor with a piston driven by an electric motor. If the compressor 3 is operating, the piston, the electric motor and the coolant flowing between the compressor 3, condenser 4 and evaporator 5 produce noises, which can be heard from outside of the refrigeration device. When the compressor 3 is switched off, these noise sources disappear, and it may be that vapor bubbles rising in the liquid coolant of the evaporator 5 occasionally also result in externally audible noises.

A control unit 6 controls the operation of the compressor 3 on the one hand with the aid of a temperature measured by a temperature sensor 7 on the storage chamber 2 and on the other hand with the aid of specifications, which a user can enter at a user interface 8.

As indicated schematically in FIG. 1, the user interface 8 includes an alphanumeric and/or graphical display element, such as for instance an LCD display 9 and a plurality of buttons 10 associated with the display element 9. The buttons 10 are shown here and in the subsequent figures, for improved clarity, separately from the display element 8, but it goes without saying that with a touch-sensitive display element, the buttons can also be formed by regions of its display surface itself.

Figure 2:
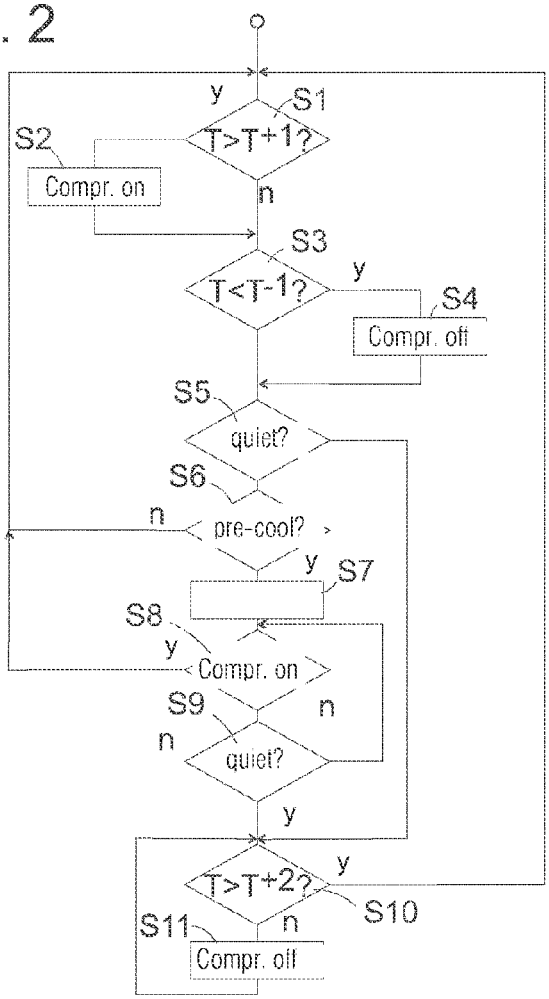
FIG. 2 shows a flow chart of a method executing in a control unit of the refrigeration device.

FIG. 2 shows, with the aid of a flow chart, the mode of operation of the control unit 6. The control unit supports three operating modes of the refrigeration device, a thermostat operating mode, an intensive refrigeration operating mode and a silent operating mode. Provided a user does not adjust anything else, the refrigeration device is in the thermostat operating mode, which includes steps S1 to S5 in FIG. 2. Steps S1 to S5 are repeated cyclically, so that the selection of one of these steps as the starting step of the method is entirely random. In step S1, the control unit 6 controls the temperature T of the storage chamber 2 measured by the temperature sensor 7 with a first upper limit temperature $T^{-1}$. In the event of this limit temperature $T^{+1}$ being exceeded, the compressor is switched on (S2), so that the temperature T drops again. In step S3, the temperature T is compared with a first lower limit temperature $T^{-1}$ and in the event of the temperature being below said limit temperature, the compressor 3 is switched off again (S4). One of the limit temperatures, $T^{+1}$ or $T^{-1}$, can be set by a user on the user interface 8. The difference between the limit temperatures is generally a predetermined fixed value. In this respect, the method corresponds to a conventional thermostat regulation of the temperature in the storage chamber 2.

Step S5 checks whether silent operation of the refrigeration device is required, wherein, as explained in more detail below, such a requirement can originate both from the user and also from a timer 6*a* forming an integral part of the control unit 6. If there is no such requirement, a check is carried out in step S6 to determine whether there is a requirement by the user or the timer 6*a* for intensive refrigeration operation. If yes, the compressor is switched on in step S7. The compressor 3 remains in operation independently of the temperature T prevailing in the storage chamber 2 until either it is determined in step S8 that a predetermined maximum permissible duration of the intensive refrigeration operation has elapsed or it is determined in step S9 that there is a requirement, which can originate in turn from the user or from the timer 6*a*, for silent operation of the refrigeration device. While, if the permitted time of the method of step S7 elapses, the method returns to the starting point S1, i.e. the device returns to thermostat operating mode, in the case of a requirement for silent operation, just as there might be in step S5, it branches to step S10.

In step S10, the temperature T of the storage chamber is compared with a second upper limit temperature $T^{+2}$, which is greater than $T^{+1}$. If a problem or a usage error are not present like for instance an inadequately closed door of the storage chamber 2, this comparison, if intensive cooling refrigeration has taken place previously, will initially result, such that the temperature T lies below the second upper limit temperature $T^{+2}$, and the compressor is switched off in step S11. It remains switched off until the temperature T of the storage chamber 2 has reached the second upper limit temperature $T^{+2}$, then the method returns to initial step S1. Silent operation is therefore achieved in that the temperature, during the exceeding of which the compressor is switched on, is in the meantime set to the increased value $T^{+2}$ compared with the value $T^{+2}$ applicable in the thermostat operating mode of steps S1 to S6. In this way and due to the fact that in the event of a preceding intensive refrigeration operation, the temperature in the storage chamber is generally lower than $T^{+1}$, it is possible for the compressor 3 to be shut off during a long time span and for the refrigeration device to thus produce practically no operating noises.

The timer 6*a* is programmable in accordance with the present invention, in order to generate commands for the transfer into the intensive refrigeration operating mode and if necessary also into the silent operating model at regularly recurring times. Corresponding commands can also be entered manually at the user interface 8 at any point.

Figure 3:
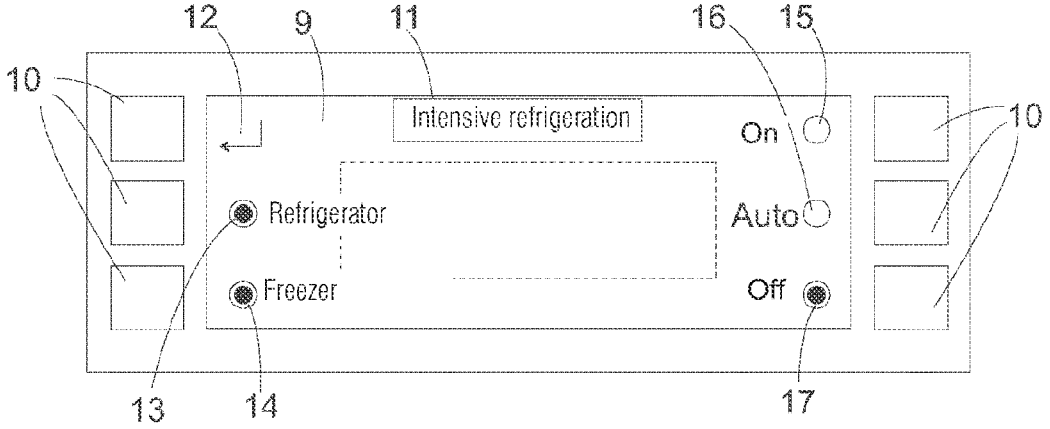
FIG. 3 shows a user interface of the refrigeration device in a state in which it is ready to accept a command from a user to switch over into the intensive refrigeration mode.

FIG. 3 shows an enlarged view of the user interface 8 with the display element 8 and the assigned buttons 10 in a state in which the user interface 8 is ready to accept entries by the user which relate to the intensive refrigeration operation. A variable status field 11 currently labeled "intensive cooling" indicates to the user that entries which he can perform momentarily on the button 10, relate to the intensive refrigeration mode. Which functions in the current state of the user interface 8 are assigned to the button 10 is apparent to the user with the aid of symbols and if necessary inscriptions shown on the display element 9 by buttons 10 adjacent thereto. An arrow symbol 12 identifies the adjacent button 10 as a return button, which can be actuated in order to return to a menu level other than that shown in FIG. 3. Circular symbols 13 or 17 adjacent to the other keys 10 each indicate an activated/selected or deactivated/deselected state. The symbols 13, 14 are, as apparent on a character identified adjacent thereto, assigned to a cooling compartment or freezer compartment. Both appear as a full circle, in order to indicate to the user that settings, which he can perform currently on the buttons 10 on the right side of the user interface 8, relate at the same time to both compartments. Provided that the user wishes to perform settings for just one of the compartments, by actuating the respective button 10 adjacent to the symbol 13 or 14, he can toggle between the selected and the deselected state of the relevant compartment.

Only one of the symbols 15 to 17 on the right side of the display element 9 can be selected at any one time, in the representation in FIG. 3, this is the symbol 17 assigned to the switch-off state. This indicates to the user that the intensive refrigeration operating mode is currently switched off, in other words the refrigeration device is in the thermostat operating mode. If the user were to press the button 10 adjacent to the symbol 15, then a full circle would appear in the symbol 15, in order to indicate that the intensive refrigeration operating mode is switched on, namely since the cooling and freezer compartment are selected, for both compartments, and the symbol 17 would appear as an empty circle.

If only one of the selected states was indicated by the symbols 13, 14 on the left side, then the choice of intensive refrigeration operating mode would only be effective for this compartment, and another operating mode could be selected for the other compartment.

With the buttons 10 on the right side of the interface 8, the user is not only able to switch the intensive refrigeration operating mode on and off, but also, by means of the button adjacent to the symbol 16, select an automatic mode, in which the timer 6*a* controls whether or at which point in time a switchover takes place into the intensive refrigeration operating mode.

Figure 4:
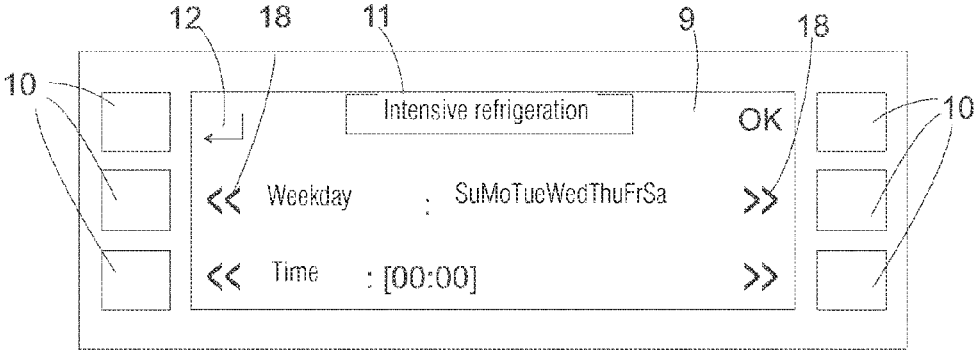
FIG. 4 shows the interface during programming intensive refrigeration operating times by a user.

A user can program the switchover times on the interface 8, since, guided by one or a number of menus (not shown) in the appended figures, he has brought the interface 8, so as to represent the menu shown in FIG. 4. Arrow symbols 18 adjacent to the two middle buttons 10 on both sides of the display element 9 clarify to the user that he can now select, with the aid of this button 10, a weekday on which he would like to predetermine a start time for the intensive refrigeration operating mode. In the representation in FIG. 4, Thursday is selected, as is apparent from the type of representation deviating from the remaining week days. With the aid of the lowest buttons 10 to the right and left of the display element 9, the user can increase or decrease the time, at which he is to begin the intensive refrigeration operating mode on the selected weekday. Actuation of a time selected in this way can take place by actuating an OK button or by selecting another weekday. If the user has successfully specified at least one weekday and one time, the timer 6*a* generates, provided automatic operation for at least one compartment of the refrigeration device is specified in the menu of FIG. 3, a command each time on the specified weekday relating to the selected time, said command allowing the control unit in the method of FIG. 2 to branch from S6 to S7.

Figure 5:
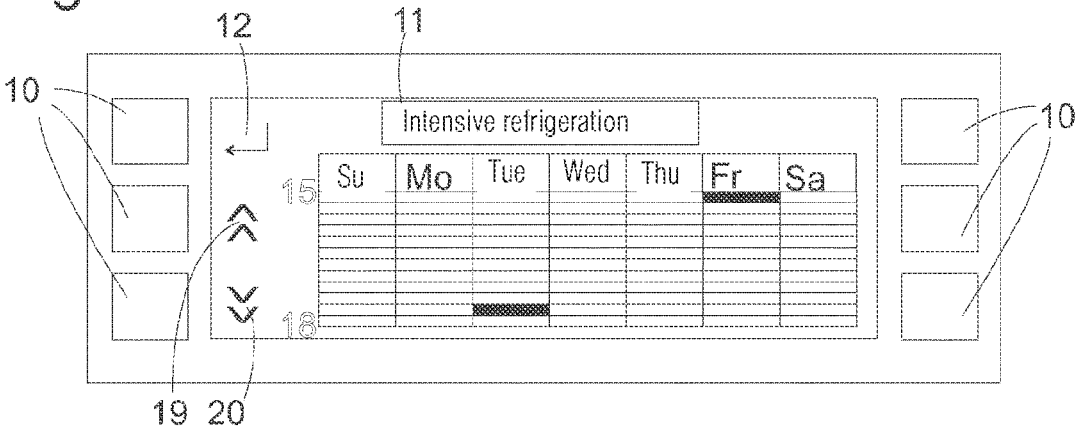
FIG. 5 shows an example of a possible distribution of intensive refrigeration operating times.

FIG. 5 shows, in the form of a screenshot of the user interface 8, an exemplary overview of the times set by the user for the intensive refrigeration operation. Whether the user interface 8 is actually in the position to indicate an overview similar to that shown here is not decisive for the functioning of the refrigeration device. It is only important that these times can be stored in the timer 6*a*, and that a user has the option of requesting to change them. The afternoon hours from 15.00 to 18.00 of all seven weekdays are shown here. The time window shown can be changed by buttons 10 adjacent to the arrow symbols 19, 20. If the user buys groceries on his way home from work on Tuesdays and Fridays, he expediently selects, as shown, a time, here Tuesdays at 17.30 and Fridays at 15.00, to start the intensive refrigeration operation, which is long enough before his likely return home, so that when he arrives home and loads the refrigeration device with his purchases, this is cooled down to significantly below $T^{-1}$. The purchases are rapidly cooled down after loading into the refrigeration device, and the duration of the interruption in the cooling cycle remains restricted to a minimum.

The duration of the intensive refrigeration operation is not specified for overview purpose in FIG. 5, since it is predetermined as a fixed value by an operating program of the control unit 6. Alternatively, one could naturally also leave the user to program the end of the intensive refrigeration operation in the same way as its start.

It is naturally also conceivable, instead of the start of the intensive refrigeration operation, to allow the user to program a point in time at which the refrigeration device is already to be precooled adequately so that a larger quantity of new purchases, which are loaded at this point in time, can be rapidly cooled down. In this case, the timer 6*a* generates a command to switch over into the intensive refrigeration operating mode prior to the actually programmed point in time, wherein the difference between both points in time is defined respectively so as to match the power of the cold generator. The user therefore does not need to be worried about how long before the predicted time instant of the loading of the refrigerated product the intensive refrigeration operation has to start, in order to achieve an adequate cooling effect.

As was already made clear in conjunction with the description of the method in FIG. 2, the intensive refrigeration operation can be used both to rapidly cool down newly stored refrigerated product and also in order to be able to maintain a silent operating mode during an adequately long time, by the control unit 6 remaining in operation, all motorized components of the refrigeration device, the movement of which generates operating noises, in particular the compressor 3 remaining switched off without resulting in an excessive heating up of the storage chamber 2. Provision can be made for the user to have the option on the user interface

Figure 6:
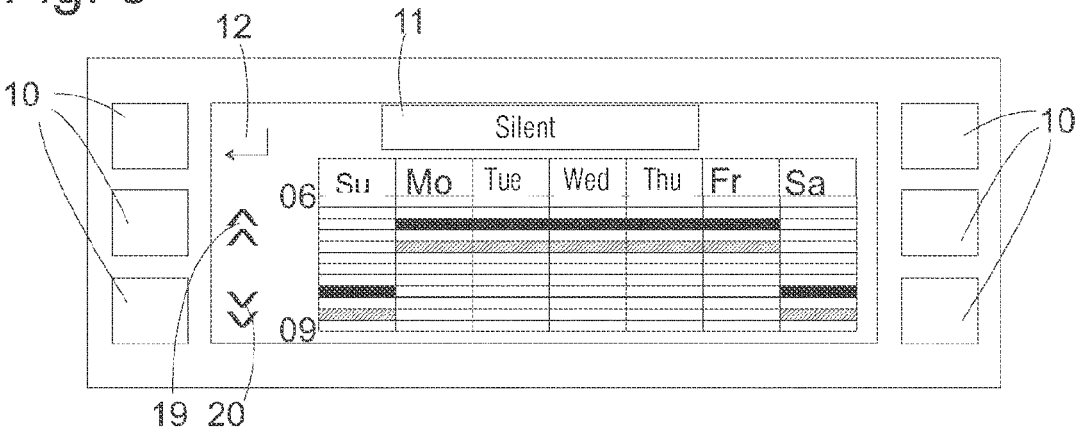
FIG. 6 shows an example of a possible distribution of times of the intensive refrigeration and silent operation.

8 to program times, at which the refrigeration device is to pass into the silent operating mode, in a similar manner to that described with respect to FIG. 4 for the start times of the intensive refrigeration operating mode. FIG. 6 shows an example of an overview of programmed times resulting therefrom. Here the user has, in each instance made apparent by sketched fields, programmed on workdays from Monday to Friday the start of the silent operation at 07.00 and Saturday and Sunday at 08.30 in accordance for instance with predicted breakfast times. The control unit 6 has automatically extended this programming by start times for the intensive refrigeration operating mode on weekdays to 06.30 and on weekends to 08.00. This ensures that at the start of the silent operation, the temperature of the storage chamber 2 lies clearly below $T^{-1}$ and the compressor 3 can remain switched off for a long time.

The invention claimed is:

1. A refrigeration device, comprising at least one storage chamber, a cold generator cooling the storage chamber and a regulating unit regulating the power of the cold generator, which is regulated between an operating state of low average power (S1-S6), in which the power of the cold generator is regulated in order to keep the temperature of the storage chamber to within a target range ($[T^1(-1), T^{+1}(+1)]$), and an operating state of high average power of the cold refrigerator can be switched over, in which the temperature of the storage chamber drops to below the target range ($[[T]^1(-1), T^1(+1)]$), the refrigeration device further comprising by a timer configured to switch the refrigeration device periodically into the operating state of high average power at times that can be set by a user.

2. The refrigeration device as claimed in claim 1, wherein the times are periodic in a weekly cycle.

3. The refrigeration device as claimed in claim 1, wherein a start time of the operating state of high average power can be entered at a user interface.

4. The refrigeration device as claimed in claim 1, wherein a time can be entered at a user interface, which is later than the start time of the operating state of high average power which is calculated therefrom.

5. The refrigeration device as claimed in claim 1, wherein it is possible to set at a user interface whether the operating state of high average power is immediately to be followed again by the operating state of low average power, or whether the cold generator is to remain switched off, until the temperature in the storage chamber is increased to above the target range ($[[T]^1(-1), T^1(+1)]$).

* * * * *